US010591160B2

(12) United States Patent
Kweon et al.

(10) Patent No.: US 10,591,160 B2
(45) Date of Patent: Mar. 17, 2020

(54) HYBRID COMBUSTION APPARATUS USING PYROLYSIS OF WATER AND COMBUSTION AIR

(71) Applicants: Eung Du Kweon, Seoul (KR); Jae Ou Chae, Seoul (KR)

(72) Inventors: Eung Du Kweon, Seoul (KR); Jae Ou Chae, Seoul (KR)

( * ) Notice: Subject to any disclaimer, the term of this patent is extended or adjusted under 35 U.S.C. 154(b) by 23 days.

(21) Appl. No.: 15/951,234

(22) Filed: Apr. 12, 2018

(65) Prior Publication Data

US 2018/0306439 A1 Oct. 25, 2018

(30) Foreign Application Priority Data

Apr. 20, 2017 (KR) ..... 10-2017-0050728

(51) Int. Cl.
*F23G 5/027* (2006.01)
*F23G 5/16* (2006.01)
(Continued)

(52) U.S. Cl.
CPC ..... *F23G 5/027* (2013.01); *F23G 5/0276* (2013.01); *F23G 5/14* (2013.01); *F23G 5/165* (2013.01);
(Continued)

(58) Field of Classification Search
CPC ..... F23G 5/027; F23G 5/0276; F23G 5/14; F23G 5/18; F23G 5/26; F23G 5/32; F23G 5/38; F23G 5/44; F23G 5/165; F23G 5/245; F23G 7/06; F23G 2202/103; F23G 2202/104; F23G 2202/106; F23G 2200/00;
(Continued)

(56) References Cited

U.S. PATENT DOCUMENTS 1,542,457 A * 6/1925 Kener, Jr. ..... F23G 5/12 110/252
1,821,263 A 9/1931 Georges Imbert
3,861,332 A * 1/1975 Itasaka ..... F23G 5/0276 110/227
4,785,744 A * 11/1988 Fontaine ..... F23G 5/165 110/214
(Continued)

FOREIGN PATENT DOCUMENTS

JP 2007-187338 A 7/2007
KR 10-2009-0030960 A 3/2009
(Continued)

*Primary Examiner* — David J Laux
(74) *Attorney, Agent, or Firm* — KORUS Patent, LLC; Seong Il Jeong

(57) ABSTRACT

The present invention is intended to provide a hybrid combustion apparatus using the pyrolysis of water and combustion air, in which a combustion chamber is defined by a double wall and divided into a primary combustion chamber configured to combust waste and a secondary combustion chamber configured to combust exhaust gas, and the size (diameter) of a combustion unit through which waste is configured to be different from that of the combustion chamber in which a flame is located, so that combustion temperature is further increased by introducing air, so that heated due to proximity to a flame, as combustion air, combustible waste is combusted at an ultrahigh temperature by pyrolyzing water and combustion air by means of a high combustion temperature, and so that complete combustion is achieved by increasing the time for which a flame stays within the combustion chamber, thereby discharging clean exhaust gas.

10 Claims, 3 Drawing Sheets

(51) Int. Cl.

| | |
|---|---|
| ***F23G 5/14*** | (2006.01) |
| ***F23J 9/00*** | (2006.01) |
| ***F23G 5/38*** | (2006.01) |
| ***F23G 5/18*** | (2006.01) |
| ***F23G 5/24*** | (2006.01) |
| ***F23G 5/32*** | (2006.01) |
| ***F23G 7/06*** | (2006.01) |
| ***F23L 9/02*** | (2006.01) |
| ***F23G 5/26*** | (2006.01) |

(52) U.S. Cl.
CPC ..... *F23G 5/18* (2013.01); *F23G 5/245* (2013.01); *F23G 5/26* (2013.01); *F23G 5/32* (2013.01); *F23G 5/38* (2013.01); *F23G 7/06* (2013.01); *F23J 9/00* (2013.01); *F23L 9/02* (2013.01); *F23G 2200/00* (2013.01); *F23G 2201/30* (2013.01); *F23G 2202/103* (2013.01); *F23G 2202/104* (2013.01); *F23G 2202/106* (2013.01); *F23G 2203/207* (2013.01); *F23G 2203/30* (2013.01); *F23G 2203/8013* (2013.01)

(58) Field of Classification Search
CPC ..... F23G 2201/30; F23G 2203/207; F23G 2203/30; F23G 2203/8013; F23J 9/00; F23L 9/02; F23L 7/00; F23L 7/005
See application file for complete search history.

(56) References Cited

U.S. PATENT DOCUMENTS

| | | | | |
|---|---|---|---|---|
| 5,050,512 | A * | 9/1991 | Tratz | F23G 5/027 110/346 |
| 5,628,261 | A | 5/1997 | Beckstead et al. | |
| 6,216,610 | B1 * | 4/2001 | Brunnmair | F23G 5/165 110/208 |
| 6,463,864 | B2 * | 10/2002 | Yamamoto | C10J 3/08 110/101 CD |
| 8,603,404 | B2 * | 12/2013 | Pinatti | C09C 1/482 201/13 |
| 8,657,892 | B2 * | 2/2014 | Patil | C10J 3/26 48/62 R |
| 9,765,962 | B2 * | 9/2017 | Sato | F23G 5/46 |
| 2004/0081929 | A1 | 4/2004 | Kim | |
| 2008/0149013 | A1 | 6/2008 | Kim | |
| 2009/0126607 | A1 * | 5/2009 | Kim | F23B 40/04 110/293 |
| 2013/0340689 | A1 | 12/2013 | Sato et al. | |

FOREIGN PATENT DOCUMENTS

| | | | |
|---|---|---|---|
| KR | 10-2009-0059867 | A | 6/2009 |
| KR | 10-1118170 | B1 | 3/2012 |
| KR | 10-2012-0059822 | A | 6/2012 |
| WO | 88/00230 | A1 | 1/1988 |
| WO | 2009/014295 | A1 | 1/2009 |

* cited by examiner

HYBRID COMBUSTION APPARATUS USING PYROLYSIS OF WATER AND COMBUSTION AIR

BACKGROUND

1. Technical Field

The present invention relates generally to a hybrid combustion apparatus using both the pyrolysis of water and the pyrolysis of combustion air, and more specifically to a hybrid combustion apparatus using the pyrolysis of water and combustion air, which can discharge clean exhaust gas by completely combusting combustible waste by means of both the pyrolysis of water and the pyrolysis of combustion air, and which can prevent secondary waste from being generated by melting combustion ash remaining after combustion in a high-frequency induction heating furnace and processing the melted ash into slag.

2. Description of the Related Art

Only an extremely small part of industrial wastes generated during industrial activities, synthetic resin products, such as tires, vinyl, and plastic, gradually increasingly used in various industrial fields and daily life, and combustible solid materials is recycled after use. Most of the waste materials are classified as waste, and are then buried in a landfill or incinerated. Accordingly, an environmental problem resulting from landfill and incineration has emerged as a social issue. Landfill has problems in that it is difficult to secure a site for landfill and buried waste contaminates soil and underground water and generates malodor because it is not sufficiently biodegradable. Incineration has a large number of problems in that serious air contamination is caused due to harmful gas and fine dust generated due to incomplete combustion during incineration, secondary environmental contamination is caused due to the processing of combustion ash remaining after combustion, and so forth.

A large number of technologies for incinerating combustible solid materials have emerged. For example, there are Korean Patent No. 181484 entitled "Spiral Staircase-type High-moisture Waste Incineration Apparatus and Method for Swirl Flame," Korean Patent No. 330814 entitled "Combustion Method for Combusting All Combustible Materials at Ultrahigh Temperature and High Speed," and Korean Patent No. 656093 entitled "Incinerator Using Combustible Waste as Fuel and Energy Recovery System Using the Same."

However, all technologies having emerged in connection with waste combustion apparatuses, including the above-described patented technologies, have the following problems:

First, a combustion chamber has a column shape, so that the size (diameter) of a portion to and in which combustible waste is introduced and combusted is the same as that of a combustion chamber in which a flame is located, with the result that the air fed to a combustion furnace is far away from the flame and thus the temperature of the introduced air is low. Accordingly, a problem arises in that combustion temperature cannot be increased to the extent that complete combustion can be achieved.

Second, the process of combusting waste and the process of completely combusting exhaust gas are not separate from each other, so that exhaust gas is not completely combusted, exhaust gas is discharged along with a material harmful to a human body, and fine fly ash dust generated during combustion is discharged without processing. Accordingly, a problem arises in that fine dust as well as a harmful material is included in exhaust gas, thereby causing environmental contamination.

Third, combustion ash remaining after the combustion of waste is discharged below a combustion chamber. Accordingly, problems arise in that secondary environmental contamination is caused due to combustion ash during the processing of the combustion ash and combustion ash is not automatically discharged. Furthermore, combustion ash discharged below the combustion chamber must be manually discharged. In some cases, a problem arises in that the operation of the combustion apparatus needs to be stopped in order to remove combustion ash.

SUMMARY

The present invention has been conceived to overcome the above-described problems, and an object of the present invention is to provide a hybrid combustion apparatus using the pyrolysis of water and combustion air, in which a combustion chamber is defined by a double wall and divided into a primary combustion chamber configured to combust waste and a secondary combustion chamber configured to combust exhaust gas, and the size (diameter) of the portion of a combustion unit through which waste is introduced is configured to be different from that of the portion of the combustion chamber in which a flame is located, so that combustion temperature is further increased by introducing air, heated due to proximity to a flame, as combustion air, so that combustible waste is combusted at an ultrahigh temperature by pyrolyzing water and combustion air by means of a high combustion temperature, and so that complete combustion is achieved by increasing the time for which a flame stays within the combustion chamber, thereby discharging clean exhaust gas.

Another object of the present invention is to provide a hybrid combustion apparatus using the pyrolysis of water and combustion air, in which combustion ash remaining after combustion is discharged through re-discharge holes formed in the lower portion of a combustion unit, is melted in a high-frequency induction heating furnace, and is then processed into slag, thereby preventing secondary waste from being generated.

According to an aspect of the present invention, there is provided a hybrid combustion apparatus using the pyrolysis of water and combustion air, the hybrid combustion apparatus including: a combustion unit configured such that the housing thereof is formed such that the center portion of the housing in a vertical direction is formed in a column shape and the top and bottom surfaces thereof are inclined, and further configured such that a waste stowage support configured such that waste introduced through a waste introduction inlet is stacked thereon while being rotated by the driving of a rotational drive device is provided inside the housing; an ignition unit installed through the top surface of the combustion unit, and configured to ignite waste; a primary combustion chamber defined by a double wall including an outer shell and an inner shell, installed above the combustion unit, and formed to have a diameter smaller than that of the column portion of the combustion unit; a primary combustion chamber air blower configured to feed combustion air from one side of the lower end portion of the primary combustion chamber to the gap of the double wall of the primary combustion chamber through a combustion chamber air feed path; a secondary combustion chamber defined by a double wall including an outer shell and an inner shell, installed above the primary combustion chamber, and configured such that an exhaust outlet configured to discharge exhaust gas is formed through one side of the upper end portion of the secondary combustion chamber; a shaftless screw pipe formed as a pipe in a column shape whose lower end is closed, vertically installed along the inner center portions of the primary and secondary combustion chambers from the upper end portion of the secondary combustion chamber to the upper end portion of the primary combustion chamber, configured such that a plurality of holes is formed at equal intervals in a portion of the shaftless screw pipe located in the primary combustion chamber, and provided therein with a shaftless screw; a secondary combustion chamber air blower configured to feed combustion air from one side of the lower end portion of the secondary combustion chamber through the gap of the double wall of the secondary combustion chamber to the shaftless screw pipe via an air blowing pipe; and a high-frequency induction heating furnace provided at the lower end of the combustion unit, and configured to melt combustion ash discharged after combustion and process the ash into slag; wherein a ring-shaped blocking plate having a predetermined width is installed at the upper end of the primary combustion chamber, the ring-shaped inner end of the blocking plate is vertically bent downward and forms an exhaust outlet vertical wall, and the lower end portion of the shaftless screw pipe is located inside the exhaust outlet vertical wall.

Preferably, the hybrid combustion apparatus further includes a spray high-pressure pump configured to spray water into an air blowing pipe adapted to feed combustion air from the secondary combustion chamber air blower to the secondary combustion chamber.

The waste stowage support may be configured such that a vertical wall is formed along the edge of a circular bottom surface, the waste stowage support has a shape having an open top, re-discharge holes through which combustion ash is discharged after the combustion of waste are formed at equal intervals along an edge circumference where the vertical wall and the bottom surface come into contact with each other, and a combustion gas guide tube is vertically installed through the center portion of the bottom surface of the waste stowage support.

Preferably, the inner shell of the primary combustion chamber has a height lower than that of the outer shell of the primary combustion chamber, a primary combustion chamber air feed inlet is formed by forming a predetermined interval between the inside surface of the inner shell of the primary combustion chamber and the exhaust outlet vertical wall; and combustion air fed by the primary combustion chamber air blower is fed to the primary combustion chamber through the double wall between the outer shell and inner shell of the primary combustion chamber and the primary combustion chamber air feed inlet via the combustion chamber air feed path.

Preferably, the inner shell of the secondary combustion chamber has a height lower than that of the outer shell of the secondary combustion chamber, the upper end of the inner shell of the secondary combustion chamber and the upper end of the shaftless screw pipe are connected by an air guide member, and the air guide member is installed to be inclined downward to the center portion thereof; and combustion air fed by the secondary combustion chamber air blower is fed to the shaftless screw pipe through the double wall between the inner shell and outer shell of the secondary combustion chamber and the air guide member via the air blowing pipe.

Preferably, the space between the lower end portions of the outer shell and the inner shell constituting the primary combustion chamber is closed by a closing plate so that combustion air fed by the primary combustion chamber air blower through the combustion chamber air feed path is fed between the outer shell and inner shell of the primary combustion chamber above the closing plate and combustion air fed through the combustion unit air feed path is fed between the outer shell and inner shell of the top surface of the combustion unit below the closing plate.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
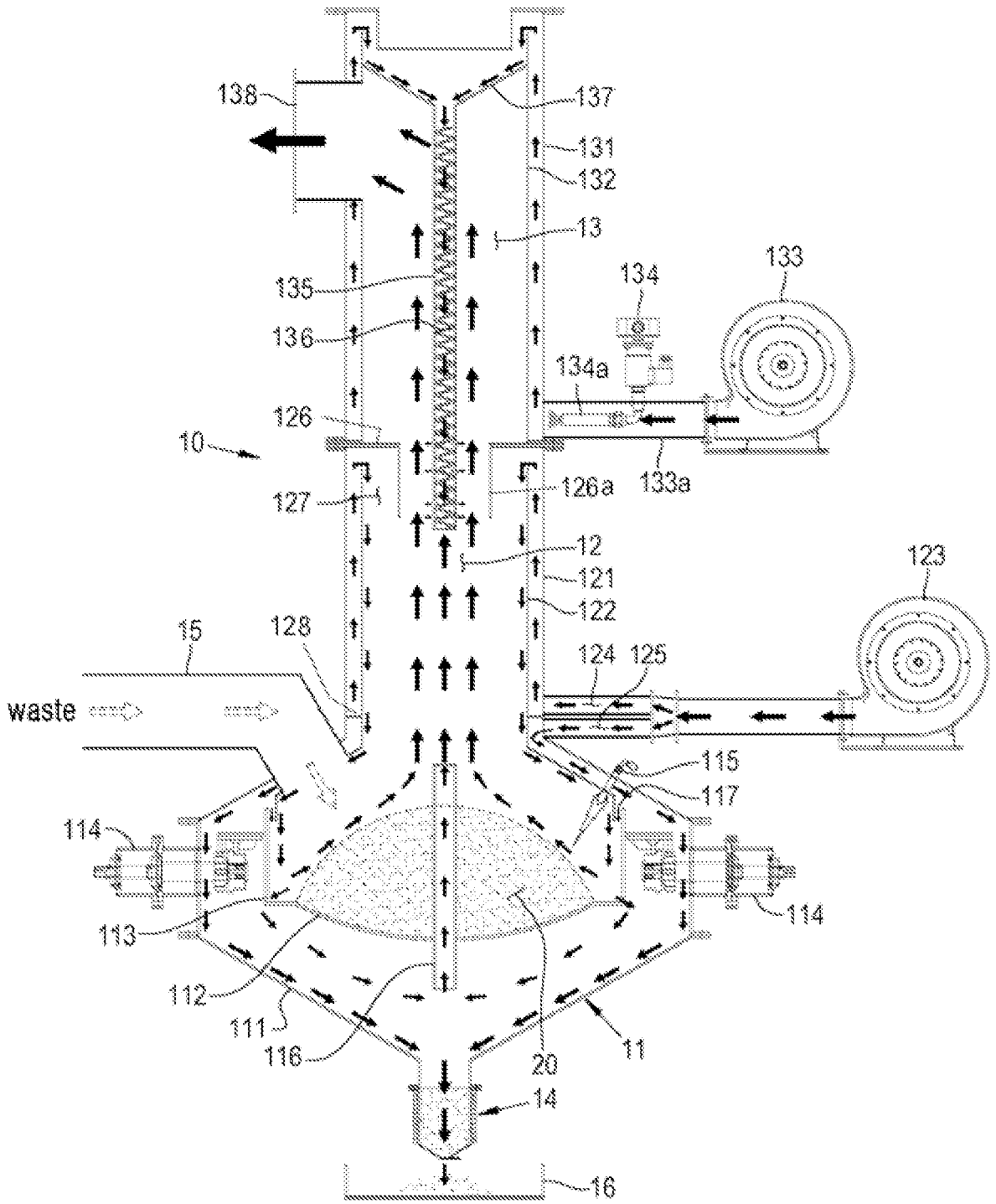
FIG. 1 is a view showing a combustion apparatus and air flow directions according to the present invention.
Figure 2:
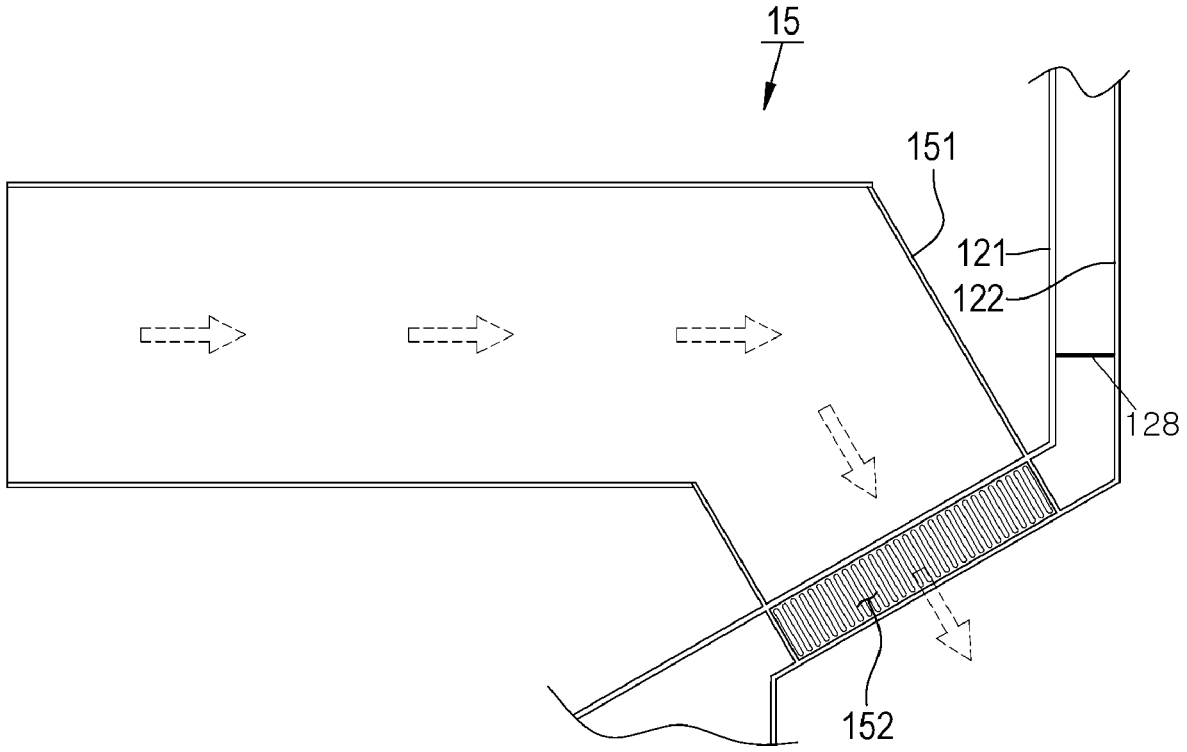
FIG. 2 is an enlarged view of a waste introduction inlet according to the present invention.
Figure 3:
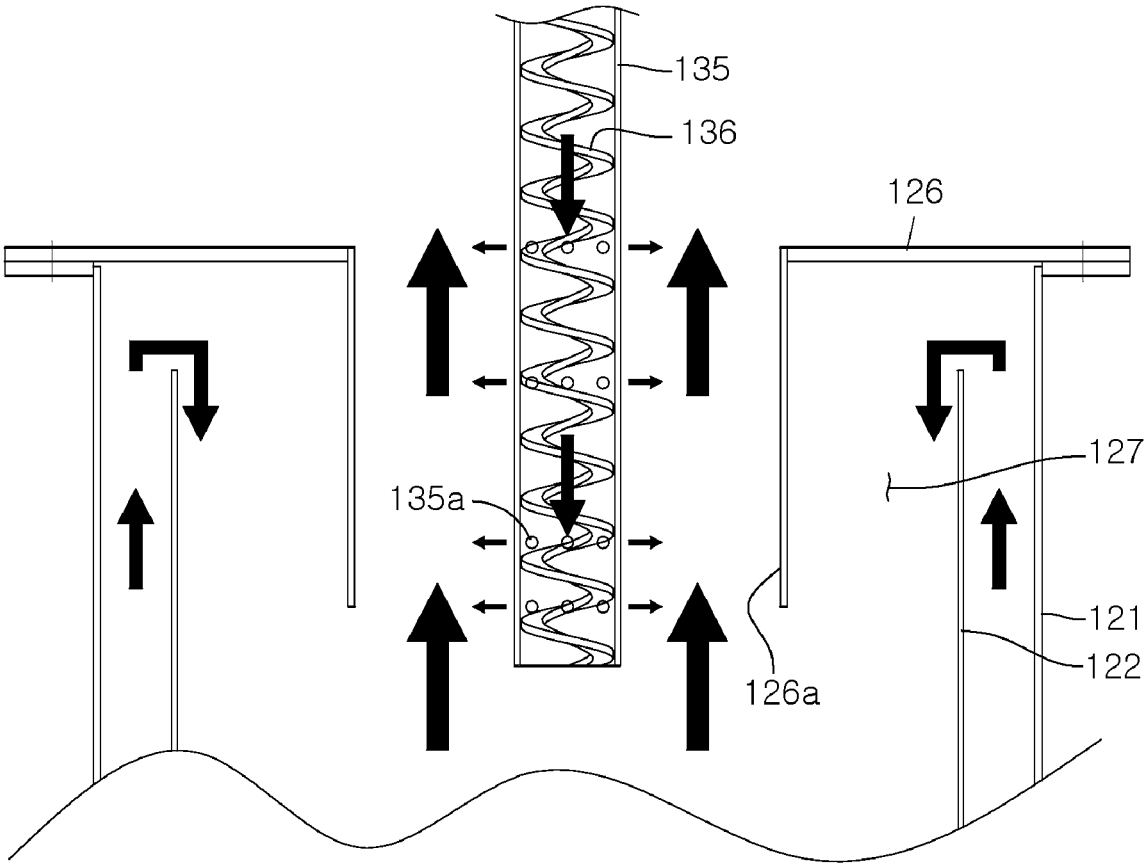
FIG. 3 is a view showing a state in which a shaftless screw pipe has been disposed between a primary combustion chamber and a secondary combustion chamber and the flow directions of exhaust gas and combustion air.

A combustion apparatus according to the present invention has the following technical features:

First, the diameter of the portion of a combustion unit through which waste is introduced is configured to be different from that of the portion of a combustion chamber in which a flame is located and the combustion chamber is defined by a double wall, so that combustion temperature can be considerably increased by introducing air, further heated due to proximity to the flame, as combustion air while being rotated along the inner wall of the double wall. Second, the combustion chamber is divided into two chambers and water and air are fed in atomic form having considerable oxidizing power by pyrolyzing water and air in molecular form in exhaust gas combusted in a primary combustion chamber, so that the exhaust gas is completely combusted in a secondary combustion chamber, thereby discharging clean exhaust gas. Third, combustion ash is melted in a high-frequency induction heating furnace and processed into slag, thereby preventing secondary waste from being generated. Fourth, a plurality of perforated holes is formed in the front end portion of a waste introduction pipe at equal intervals, thereby preventing a flame from moving backward to an introduction inlet.

A combustion apparatus 10 according to the present invention is configured such that waste is combusted in a primary combustion chamber 12 and exhaust gas non-combusted in the primary combustion chamber 12 is completely combusted in a secondary combustion chamber 13 by pyrolyzing water and air in molecular form and feeding O and OH in atomic form having high oxidizing power to the non-combusted exhaust gas. The combustion apparatus 10 basically includes: a combustion unit 11 equipped with an ignition unit 115; the primary and secondary combustion chambers 12 and 13; primary and secondary combustion chamber air blowers 123 and 133 configured to feed combustion air to the combustion chambers; a shaftless screw pipe 135 configured to pyrolyze water and air; and a high-frequency induction heating furnace 14 configured to process combustion ash. In order to generate a swirl flame in a whirlwind form, it is preferable to blow the combustion air, fed by the primary and secondary combustion chamber air blowers 123 and 133, in the tangential direction of the primary and secondary combustion chambers 12 and 13.

In the combustion unit 11, a housing 111 is formed such that the center portion thereof in a vertical direction is formed in a column shape and the top and bottom surfaces thereof are inclined in cone shapes, a waste stowage support 112 configured such that waste 20 introduced through a waste introduction inlet 15 is stacked thereon while being rotated by a rotational drive device 114 configured to generate power is provided inside the housing 111, and the ignition unit 115 configured to ignite the waste 20 is installed through the top surface of the housing 111. As described above, the top surface of the housing 111 is formed in a cone shape whose sectional area decreases in an upward direction, and thus a cross-sectional combustion area is wide and air (oxygen) feed increases, with the result that combustion time is reduced, thereby enabling high-speed combustion and thus increasing combustion temperature. Furthermore, the bottom surface of the housing 111 is formed in a cone shape whose sectional area decreases in a downward direction, and thus a cyclone dust collection function of collecting combustion ash at one location is performed.

In the waste stowage support 112, a vertical wall is formed along the edge of a circular bottom surface, the top thereof is open, and re-discharge holes 113 are formed at equal intervals along an edge circumference where the vertical wall and the bottom surface come into contact with each other. Accordingly, after waste has been combusted during the rotation of the waste stowage support 112, combustion ash is discharged through the re-discharge holes 113 along with the flow of combustion air, naturally runs down the bottom surface of the housing 111, and is introduced into the high-frequency induction heating furnace 14. In order to allow combustion air to flow desirably, it is preferable to form the bottom surface of the waste stowage support 112 into a downwardly convex shape rather than a flat shape. The downwardly convex bottom surface does not generate a vortex, but allows combustion air to flow naturally.

A combustion gas guide tube 116 is vertically installed through the center portion of the bottom surface of the waste stowage support 112. The combustion gas discharged through the re-discharge holes 113 discharges combustion ash toward the high-frequency induction heating furnace 14 by pushing the combustion ash downward, and is raised while being guided to the primary combustion chamber 12 through the combustion gas guide tube 116 due to a convention phenomenon. Furthermore, the combustion air fed by the primary combustion chamber air blower 123 is fed through a combustion unit air feed path 125, passes between an outer shell and an inner shell constituting the top surface of the housing 111 of the combustion unit, and is fed along the inclined bottom surface of the housing 111. During this process, the combustion air guides combustion ash to the high-frequency induction heating furnace 14.

The primary combustion chamber 12 is defined by a double wall formed by disposing an outer shell 121 and an inner shell 122 at a predetermined interval, is installed above the combustion unit 11, and has a diameter smaller than that of the center column portion of the combustion unit 11. According to one feature of the present invention, the diameter of the combustion chamber is configured to be smaller than that of the combustion unit 11, and thus the cross-sectional combustion area of the combustion unit 11 becomes wide and a combustion nucleus (a flame) is formed into a fire pillar shape and raised to the primary combustion chamber 12. The combustion air fed downward to the primary combustion chamber 12 while circling along the inner circumferential surface of the inner wall 122 can be located in proximity to the combustion nucleus (the flame), and thus the combustion air is fed at a higher temperature, thereby further increasing combustion temperature.

The height of the inner shell 122 of the primary combustion chamber 12 is lower than that of the outer shell 121, a ring-shaped blocking plate 126 having a predetermined width is installed at the upper end of the primary combustion chamber 12, the end of the inside of the ring-shaped blocking plate 126 is vertically bent downward and forms an exhaust outlet vertical wall 126*a*, and the lower end of the shaftless screw pipe 135 is located inside the exhaust outlet vertical wall 126*a*. The exhaust gas combusted in the primary combustion chamber 12 is discharged to the secondary combustion chamber 13 through a space between the exhaust outlet vertical wall 126*a* and the shaftless screw pipe 135 in a space surrounded by the exhaust outlet vertical wall 126*a*.

A primary combustion chamber air feed inlet 127 is formed by defining a predetermined interval between the inside surface of the inner shell 122 of the primary combustion chamber 12 and the exhaust outlet vertical wall 126*a*. The combustion air fed by the primary combustion chamber air blower 123 installed at the lower end of the primary combustion chamber 12 is raised up to the blocking plate 126 of the primary combustion chamber 12 through the combustion chamber air feed path 124 while being spirally rotated along the double wall between the outer shell 121 and inner shell of the primary combustion chamber 122, is passed through the combustion chamber air feed inlet 127, and is lowered near the combustion nucleus (the flame), i.e., the fire pillar of the primary combustion chamber 12, while being spirally rotated along the wall surface of the primary inner shell 122. During this process, the combustion air is further heated, and is fed to the primary combustion chamber 12. The combustion air is lowered along the inner circumferential surface of the inner shell of the top surface of the housing 111 and combusts the waste 20, and then exhaust gas is raised while being spirally rotated in the center portion of the primary combustion chamber 12. For the overall process, refer to the combustion gas flow paths (arrows) of FIG. 1.

The secondary combustion chamber 13 is defined by a double wall formed by disposing an outer shell 131 and an inner shell 132 at a predetermined interval, and is installed above the primary combustion chamber 12. An exhaust outlet 138 configured to discharge exhaust gas is formed in one side of the upper end portion of the secondary combustion chamber 13, and the upper end of the secondary combustion chamber 13 is closed. The height of the inner shell 132 of the secondary combustion chamber 13 is lower than that of the outer shell 131, the upper end of the inner shell 132 of the secondary combustion chamber 13 and the upper end of the shaftless screw pipe 135 are connected by an air guide member 137, and the air guide member 137 is installed to be inclined downward to the center thereof.

The secondary combustion chamber air blower 133 is installed on one side of the lower end portion of the secondary combustion chamber 13, and feeds combustion air to the shaftless screw pipe 135. The combustion air fed by the secondary combustion chamber air blower 133 is passed through the double wall between the inner shell 132 and outer shell 131 of the secondary combustion chamber 13 and the air guide member 137 via an air blowing pipe 133*a*, is fed to the top of the shaftless screw pipe 135 while being spirally rotated, is fed downward along a coil spring-shaped shaftless screw 136 inside the shaftless screw pipe 135, and is discharged through holes 135*a* formed in the lower end portion of the shaftless screw pipe 135. The shaftless screw 136 is formed in a spiral coil shape. Accordingly, the shaftless screw 136 increases the time for which the combustion air stays, and also increases the temperature of the combustion air while being lowered, thereby allowing water and air in molecular form to be decomposed into O and OH in atomic form having considerable oxidizing power.

The shaftless screw pipe 135 is a pipe in a column shape whose lower end is closed. The shaftless screw pipe 135 is provided therein with the coil spring-shaped shaftless screw 136. The shaftless screw pipe 135 is vertically installed along the inner center portions of the primary and secondary combustion chambers from the lower end of the air guide member 137 located in the upper end portion of the secondary combustion chamber 13 to the lower end portion of the exhaust outlet vertical wall 126*a* located in the upper end portion of the primary combustion chamber 12. The plurality of holes 135*a* is formed at equal intervals in the portion of the shaftless screw pipe 135 located in the exhaust outlet vertical wall 126*a* of the primary combustion chamber. Accordingly, the combustion air fed by the secondary combustion chamber air blower 133 acts as an air curtain for the flame raised from the primary combustion chamber 12 to the secondary combustion chamber 13 while being sprayed through the holes 135*a*. This increases the time for which the flame stays inside the primary combustion chamber 12, and also prevents fine fly ash from being introduced into the secondary combustion chamber 13.

Water (H2O) is pyrolyzed into O and OH at a temperature of about 800° C. OH has considerable oxidizing power. Accordingly, it is preferable to further install a spray high-pressure pump 134 configured to spray water into the air blowing pipe 133*a* which feeds combustion air from the secondary combustion chamber air blower 133 to the secondary combustion chamber 13. Water and air fed in molecular form are pyrolyzed into O and OH in atomic form having considerable oxidizing power due to a high temperature while running down the shaftless screw pipe 135, O and OH are sprayed through the plurality of holes 135*a*, and the exhaust gas non-combusted in the primary combustion chamber 12 is completely combusted in the secondary combustion chamber 13, thereby discharging completely combusted and clean exhaust gas.

The space (interval) between the lower end portions of the outer shell 121 and the inner shell 122 constituting the primary combustion chamber 12 is closed by a closing plate 128. Accordingly, when the combustion air fed by the primary combustion chamber air blower 123 is fed through the combustion chamber air feed path 124, the combustion air is passed between the outer shell 121 and inner shell 122 of the primary combustion chamber 12 above the closing plate 128, and is fed to the primary combustion chamber 12. Furthermore, when the combustion air fed by the primary combustion chamber air blower 123 is fed through the combustion unit air feed path 125, the combustion air is passed between the outer shell and inner shell of the top surface of the combustion unit housing 111 below the closing plate 128, and is fed to the combustion unit housing 111.

The upper inclined surface of the combustion unit housing 111 is defined by a double wall formed by disposing an outer shell and an inner shell at a predetermined interval, like the primary and secondary combustion chambers 12 and 13. A part of the combustion air blown by the primary combustion chamber air blower 123 is fed to the waste stowage support 112 of the combustion unit through a path between the combustion unit air feed path 125 and the double wall, and the remaining part is divided and fed along the inner wall of the combustion unit housing 111. The air fed to the waste stowage support 112 is discharged along with combustion ash through the re-discharge holes 113. Accordingly, combustion ash is pushed toward the high-frequency induction heating furnace 14 located below the combustion ash, and exhaust gas is raised up to the primary combustion chamber 12 through the combustion gas guide tube 116 vertically installed at the center of the bottom surface of the waste stowage support 112.

The waste introduction inlet 15 is installed such that waste is introduced along the inclined top surface of the combustion unit housing 111. The portion of a waste introduction pipe 151 located through the inclined top surface of the combustion unit housing 111, which is located between the outer shell and inner shell of the combustion unit housing 111, forms a perforated hole screen mesh 152 in which perforated holes are formed at equal intervals. The perforated holes are formed in circular shapes or in slot shapes whose lengths in the direction of the waste introduction pipe 151 are longer. The perforated hole screen mesh 152 prevents introduced waste or a flame from moving backward to the inlet.

The high-frequency induction heating furnace 14 is provided at the lower end of the housing 111 of the combustion unit 11. The high-frequency induction heating furnace 14 eliminates ash and converts ash into slag by melting the ash, discharged after combustion, at a high temperature, thereby eliminating environmental contamination materials attributable to combustion ash. Since the high-frequency induction heating furnace 14 is not unique to the present invention but is widely used in various fields, a detailed description thereof is omitted. Reference symbol 16 designates a slag collection container which is installed below the high-frequency induction heating furnace 14.

The hybrid combustion apparatus according to the present invention is configured such that the diameter of the portion of the combustion unit through which waste is introduced is configured to be different from that of the portion of the combustion chamber in which a flame is located and such that the combustion unit is formed in a cone shape whose diameter decreases upward, so that a large amount of combustion air (oxygen) is fed to the combustion unit due to its large surface area, and thus combustion is rapidly performed at a high speed, so that combustion air fed while being rotated along the inner wall of the combustion chamber via the double wall of the combustion chamber maximally approaches a flame and is fed as more heated combustion air, and thus combustion temperature can be further increased, and so that a cone-shaped flame is raised in a rotating fire pillar shape having a whirlwind form in the center portion of the combustion chamber, and thus combustion temperature can be considerably increased.

Furthermore, the chamber is divided into the primary combustion chamber configured to combust waste and the secondary combustion chamber configured to combust exhaust gas; water and combustion air in molecular form are pyrolyzed into O and OH in atomic form having considerably high oxidizing power and fed through the holes formed in the side surface of the shaftless screw pipe installed inside the secondary combustion chamber located above the primary combustion chamber, and thus exhaust gas is oxidized and completely combusted; combustion gas discharged through the holes formed in the side surface of the shaftless screw pipe acts as an air curtain near the entrance of the secondary combustion chamber, and thus the time for which exhaust gas stays in the primary combustion chamber is increased and combustion ash is prevented from flying and being discharged into the secondary combustion chamber; and the combustion gas is re-combusted inside the secondary combustion chamber, and thus clean exhaust gas without harmful gas or fine dust is discharged.

Moreover, the hybrid combustion apparatus according to the present invention is configured such that combustion ash remaining after combustion is automatically discharged through the re-discharge holes formed through the waste stowage support of the combustion unit by means of the flow of combustion air, and such that combustion ash is naturally guided to the high-frequency induction heating furnace by means of a cyclone dust collection function due to the cone shape of the housing of the combustion unit, is melted in the high-frequency induction heating furnace at a high temperature, and is processed into slag, thereby preventing secondary waste from being generated.

Since the above description is intended to illustrate the present invention and the embodiments described in the present specification are not intended to limit the technical spirit of the present invention but is intended to illustrate the technical spirit of the present invention, it will be apparent to a person having ordinary knowledge in the art to which the present invention pertains that various modifications and alterations may be made without departing from the technical spirit of the present invention. Therefore, the range of protection of the present invention should be interpreted based on the attached claims, and technologies falling within a range equivalent to the attached claims should be interpreted as being included in the range of the rights of the present invention.

What is claimed is:

1. A hybrid combustion apparatus using pyrolysis of water and combustion air, the hybrid combustion apparatus comprising:

a combustion unit configured such that a housing thereof is formed such that a center portion of the housing in a vertical direction is formed in a column shape and top and bottom surfaces thereof are inclined, and further configured such that a waste stowage support configured such that waste introduced through a waste introduction inlet is stacked thereon while being rotated by driving of a rotational drive device is provided inside the housing;

an ignition unit installed through a top surface of the combustion unit, and configured to ignite waste;

a primary combustion chamber defined by a double wall including an outer shell and an inner shell, installed above the combustion unit, and formed to have a diameter smaller than that of a column portion of the combustion unit;

a primary combustion chamber air blower configured to feed combustion air from one side of a lower end portion of the primary combustion chamber to a gap of the double wall of the primary combustion chamber through a combustion chamber air feed path;

a secondary combustion chamber defined by a double wall including an outer shell and an inner shell, installed above the primary combustion chamber, and configured such that an exhaust outlet configured to discharge exhaust gas is formed through one side of an upper end portion of the secondary combustion chamber;

a shaftless screw pipe formed as a pipe in a column shape whose lower end is closed, vertically installed along inner center portions of the primary and secondary combustion chambers from an upper end portion of the secondary combustion chamber to an upper end portion of the primary combustion chamber, configured such that a plurality of holes is formed at equal intervals in a portion of the shaftless screw pipe located in the primary combustion chamber, and provided therein with a shaftless screw;

a secondary combustion chamber air blower configured to feed combustion air from one side of a lower end portion of the secondary combustion chamber through a gap of the double wall of the secondary combustion chamber to the shaftless screw pipe via an air blowing pipe; and a high-frequency induction heating furnace provided at a lower end of the combustion unit, and configured to melt combustion ash discharged after combustion and process the ash into slag;

wherein a ring-shaped blocking plate having a predetermined width is installed at an upper end of the primary combustion chamber, a ring-shaped inner end of the blocking plate is vertically bent downward and forms an exhaust outlet vertical wall, and a lower end portion of the shaftless screw pipe is located inside the exhaust outlet vertical wall.

2. The hybrid combustion apparatus of claim 1, further comprising a spray high-pressure pump configured to spray water into an air blowing pipe adapted to feed combustion air from the secondary combustion chamber air blower to the secondary combustion chamber.

3. The hybrid combustion apparatus of claim 1, wherein the waste stowage support is configured such that a vertical wall is formed along an edge of a circular bottom surface, the waste stowage support has a shape having an open top, and re-discharge holes through which combustion ash is discharged after combustion of waste are formed at equal intervals along an edge circumference where the vertical wall and the bottom surface come into contact with each other.

4. The hybrid combustion apparatus of claim 3, wherein a combustion gas guide tube is vertically installed through a center portion of the bottom surface of the waste stowage support.

5. The hybrid combustion apparatus of claim 1, wherein an upper inclined surface of the combustion unit is defined by a double wall including an outer shell and an inner shell, and is configured such that combustion air blown by the primary combustion chamber air blower is fed along the waste stowage support and an inner wall of the combustion unit housing through the combustion unit air feed path and a gap of the double wall.

6. The hybrid combustion apparatus of claim 1, wherein:

the inner shell of the primary combustion chamber has a height lower than that of the outer shell of the primary combustion chamber, a primary combustion chamber air feed inlet is formed by forming a predetermined interval between an inside surface of the inner shell of the primary combustion chamber and the exhaust outlet vertical wall; and combustion air fed by the primary combustion chamber air blower is fed to the primary combustion chamber through the double wall between the outer shell and inner shell of the primary combustion chamber and the primary combustion chamber air feed inlet via the combustion chamber air feed path.

7. The hybrid combustion apparatus of claim 1, wherein:

the inner shell of the secondary combustion chamber has a height lower than that of the outer shell of the secondary combustion chamber, an upper end of the inner shell of the secondary combustion chamber and an upper end of the shaftless screw pipe are connected by an air guide member, and the air guide member is installed to be inclined downward to a center portion thereof; and combustion air fed by the secondary combustion chamber air blower is fed to the shaftless screw pipe through the double wall between the inner shell and outer shell of the secondary combustion chamber and the air guide member via the air blowing pipe.

8. The hybrid combustion apparatus of claim 1, wherein:

a lower end portion of the shaftless screw pipe is located inside the exhaust outlet vertical wall, and combustion air is sprayed through the holes formed in the lower end portion of the shaftless screw pipe; and the combustion air sprayed through the holes formed in the lower end portion of the shaftless screw pipe acts as an air curtain for a flame raised from the primary combustion chamber to the secondary combustion chamber, so that a period for which the flame stays inside the primary combustion chamber is increased.

9. The hybrid combustion apparatus of claim 1, wherein:

the waste introduction inlet is installed to introduce waste through the inclined top surface of the combustion unit; and a part of a waste introduction pipe located through the inclined top surface of the combustion unit, which is located between the outer shell and the inner shell, forms a perforated hole screen mesh in which perforated holes are formed at equal intervals.

10. The hybrid combustion apparatus of claim 1, wherein a space between lower end portions of the outer shell and the inner shell constituting the primary combustion chamber is closed by a closing plate so that combustion air fed by the primary combustion chamber air blower through the combustion chamber air feed path is fed between the outer shell and inner shell of the primary combustion chamber above the closing plate and combustion air fed through the combustion unit air feed path is fed between an outer shell and inner shell of the top surface of the combustion unit below the closing plate.

* * * * *